US007862865B2

(12) United States Patent
Truesdale, III et al.

(10) Patent No.: US 7,862,865 B2
(45) Date of Patent: Jan. 4, 2011

(54) ULTRAVIOLET-RESISTANT FABRICS AND METHODS FOR MAKING THEM

(75) Inventors: Rembert Joseph Truesdale, III, Thomaston, GA (US); Phillip H. Riggins, Greensboro, NC (US)

(73) Assignee: Southern Mills, Inc., Union City, GA (US)

( * ) Notice: Subject to any disclaimer, the term of this patent is extended or adjusted under 35 U.S.C. 154(b) by 227 days.

(21) Appl. No.: 11/715,729

(22) Filed: Mar. 8, 2007

(65) Prior Publication Data

US 2007/0248765 A1 Oct. 25, 2007

Related U.S. Application Data

(62) Division of application No. 11/407,649, filed on Apr. 20, 2006.

(51) Int. Cl.
*B05D 1/18* (2006.01)
*B32B 27/04* (2006.01)

(52) U.S. Cl. ..... 427/430.1; 427/434.6; 442/131; 442/132; 442/133

(58) Field of Classification Search ..... 427/430.1, 427/443.2
See application file for complete search history.

(56) References Cited

U.S. PATENT DOCUMENTS

| | | | | |
|---|---|---|---|---|
| 3,802,841 | A | 4/1974 | Robin | |
| 3,888,821 | A | 6/1975 | Milford, Jr. | |
| 4,710,200 | A | 12/1987 | Cates et al. | |
| 4,741,740 | A | 5/1988 | Davis et al. | |
| 4,749,378 | A | 6/1988 | Cates et al. | |
| 4,755,335 | A | 7/1988 | Ghorashi | |
| 4,759,770 | A | 7/1988 | Cates et al. | |
| 4,814,222 | A | 3/1989 | Davis et al. | |
| 4,898,596 | A | 2/1990 | Riggins et al. | |
| 4,910,078 | A | 3/1990 | Hill et al. | |
| 4,985,046 | A | 1/1991 | Hartzler | |
| 5,089,298 | A | 2/1992 | McNally et al. | |
| 5,174,790 | A | 12/1992 | Riggins et al. | |
| 5,200,262 | A | 4/1993 | Li | |
| 5,207,803 | A | 5/1993 | Holsten et al. | |
| 5,211,720 | A | 5/1993 | Johnson | |
| 5,215,545 | A | 6/1993 | Cates et al. | |
| 5,221,287 | A | 6/1993 | Reinert | |
| 5,306,312 | A | 4/1994 | Riggins et al. | |
| 5,514,457 | A | 5/1996 | Fels et al. | |
| 6,015,570 | A | 1/2000 | Tucci et al. | |
| 6,025,284 | A * | 2/2000 | Marco et al. | 442/133 |
| 6,110,558 | A | 8/2000 | Billingsley et al. | |
| 6,132,476 | A | 10/2000 | Lunsford et al. | |
| 6,312,802 | B1 | 11/2001 | Nishida et al. | |
| 6,451,070 | B1 | 9/2002 | Kent et al. | |
| 6,840,967 | B1 | 1/2005 | Riggins et al. | |
| 7,264,637 | B2 | 9/2007 | Cardamone et al. | |
| 7,279,520 | B2 | 10/2007 | Hausmann et al. | |
| 2005/0022313 | A1 * | 2/2005 | Scheidler | 8/115.51 |
| 2005/0106967 | A1 | 5/2005 | Suzuki | |
| 2005/0109994 | A1 * | 5/2005 | Matheson et al. | 252/609 |
| 2005/0239927 | A1 * | 10/2005 | Leggio et al. | 524/100 |
| 2006/0000025 | A1 | 1/2006 | Dixon et al. | |
| 2006/0034882 | A1 | 2/2006 | Chen et al. | |
| 2007/0009563 | A1 | 1/2007 | Hataipitisuk | |
| 2007/0157395 | A1 | 7/2007 | Cao | |
| 2007/0192966 | A1 | 8/2007 | Cottrell et al. | |

FOREIGN PATENT DOCUMENTS

| | | | |
|---|---|---|---|
| EP | 0605939 | A | 7/1994 |
| EP | 0609600 | A | 8/1994 |
| EP | 0478301 | B1 | 6/1995 |
| EP | 0 787 851 | A | 8/1997 |
| EP | 1 090 552 | A | 4/2001 |
| EP | 1209279 | A1 | 5/2002 |
| EP | 1 944 408 | A | 7/2008 |
| GB | 1438067 | A | 6/1976 |
| JP | 06-192972 | A | 7/1994 |
| WO | 95/17091 | A | 6/1995 |
| WO | 99/00245 | A | 1/1999 |
| WO | 01/37662 | A | 5/2001 |
| WO | 01/58261 | A | 8/2001 |
| WO | 2004/058902 | A | 7/2004 |
| WO | 20060017709 | A | 2/2006 |
| WO | 2008/004711 | A | 1/2008 |
| WO | 2008/032844 | | 3/2008 |

OTHER PUBLICATIONS

RD364027A, Aug. 1994, Ciba Geigy AG.*
International Search Report and Written Opinion for PCT/US2007/088268, mailed May 26, 2009.

* cited by examiner

*Primary Examiner*—David Turocy
(74) *Attorney, Agent, or Firm*—Kilpatrick Stockton LLP

(57) ABSTRACT

Embodiments of the invention can provide a protective fabric includes a plurality of inherently flame resistant fibers, and at least one ultraviolet-resistant additive incorporated into the inherently flame resistant fibers through a dye process using a carrier, wherein the ultraviolet-resistant additive significantly increases at least one of the strength retention and the color-fastness of the fabric when exposed to ultraviolet radiation.

17 Claims, 1 Drawing Sheet

ULTRAVIOLET-RESISTANT FABRICS AND METHODS FOR MAKING THEM

RELATED APPLICATION

This is a divisional application of U.S. patent application Ser. No. 11/407,649, filed Apr. 20, 2006 which is herein incorporated by reference.

BACKGROUND

Protective garments are often constructed from high-strength, inherently flame resistant fabrics, such as fabrics comprising aramid materials. Although such fabrics are strong and, therefore, can provide the desired degree of protection to the wearer, the strength of these fabrics can be compromised through exposure to ultraviolet (UV) rays, such as those emitted by the sun and other light sources. In fact, it is not unusual for the fabrics of such garments to lose 50% or more of theft original strength after repeated exposure to daylight.

Unfortunately, protective garments of the type described above are often worn outdoors. For example, such garments are used by various utility personnel and other industrial workers. In such cases, the strength of the protective garment can decline as use of the garment continues, even over a relatively short period of time. This results in decreased protection for the wearer, as well as increased costs in replacing compromised garments.

In addition to reducing the strength of protective garments, UV exposure can further adversely affect the color of the garments. Specifically, UV exposure can reduce the colorfastness of such garments, causing their color to fade as the duration of UV exposure increases. Such fading is undesirable from an aesthetics point of view. In some cases, however, such fading can decrease the visibility of the garment, and therefore the wearer. This phenomenon is especially undesirable for high-visibility garments used near roadways and other hazardous areas in which failure to see the wearer may result in harm to that wearer.

In view of the above, it would be desirable to be able to produce protective fabric that has greater resistance to UV radiation.

SUMMARY OF THE INVENTION

Disclosed are protective fabrics and methods for making protective fabrics. In one embodiment, a protective fabric includes a plurality of inherently flame resistant fibers, and at least one ultraviolet-resistant additive incorporated into the inherently flame resistant fibers through a dye process using a carrier, wherein the ultraviolet-resistant additive significantly increases at least one of the strength retention and the colorfastness of the fabric when exposed to ultraviolet radiation.

In one embodiment, a method includes immersing a fabric in a mixture comprising a carrier and a ultraviolet-resistant additive, the fabric comprising a plurality of inherently flame resistant fibers, solubilizing the ultraviolet-resistant additive with the carrier so that the ultraviolet-resistant additive is absorbed by the inherently flame resistant fibers, wherein absorption of the ultraviolet-resistant additive into the inherently flame resistant fibers significantly increases at least one of the strength retention and the colorfastness of the fibers when exposed to ultraviolet radiation.

BRIEF DESCRIPTION OF THE DRAWINGS

The fabrics and methods of the present disclosure can be better understood with reference to the following drawings. Features shown in these drawings are not necessary drawn to scale.

DETAILED DESCRIPTION

As is described above, the strength and/or colorfastness of fabrics used to construct protective garments can be significantly reduced due to ultraviolet (UV) exposure. As is described in the following, however, the resistance of such fabrics to UV radiation can be significantly improved by incorporating UV-resistant additives into the fibers of such fabrics. When such additives are incorporated into the fabric fibers, the strength loss and/or color fading that can occur due to UV exposure can be reduced.

Figure 1:
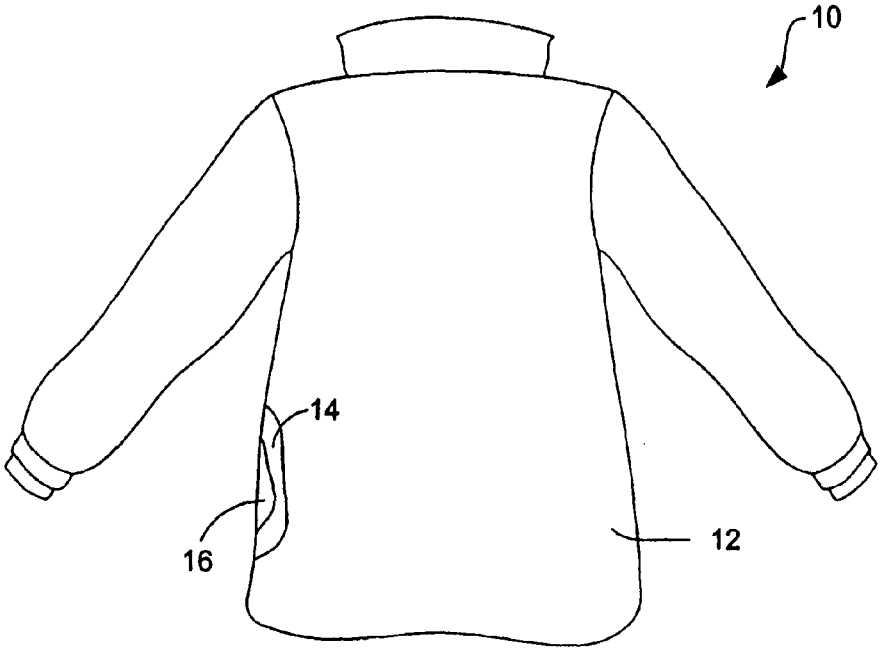
FIG. 1 is a front view of an example protective garment that is constructed of a high-strength, flame-resistant fabric.

FIG. 1 illustrates an example protective garment 10. As is shown in that figure, the garment 10 comprises a firefighter turnout coat that can be donned by firefighter personnel when exposed to flames and extreme heat. As is indicated in FIG. 1, the garment 10 generally comprises an outer shell 12 that forms the exterior surface of the garment, a moisture barrier 14 that forms an intermediate layer of the garment, and a thermal liner 16 that forms the interior surface (i.e., the surface that contacts the wearer) of the garment.

Figure 2:
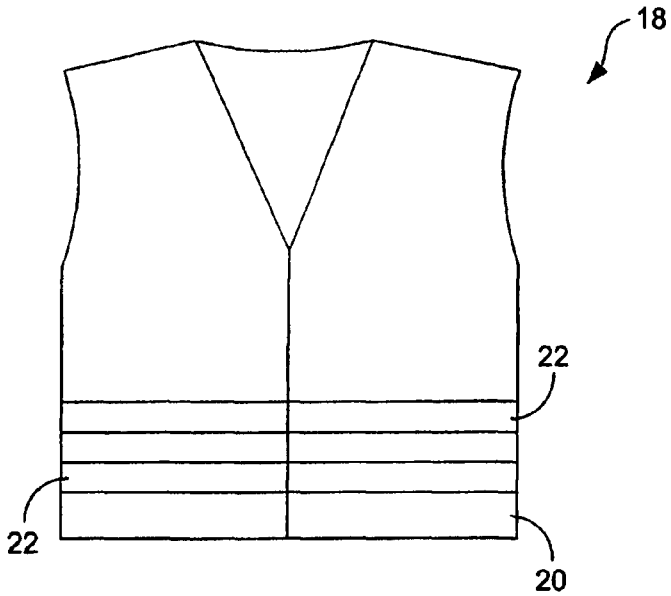
FIG. 2 is a front view of a further example garment that is constructed of a high-strength, flame resistant fabric.

FIG. 2 illustrates a further example garment 18. The garment 18 comprises a vest of the type that may be worn by a utility lineman. As is indicated in FIG. 2, the garment 18 includes an outer layer 20 of material, which may be dyed a bright shade that is easily identifiable for safety purposes. Optionally, the garment 18 includes reflective (e.g., retroreflective) stripes 22, which aid observers in seeing the wearer of the garment, especially at night.

It is noted that, although a firefighter turnout coat and lineman vest are shown in the figures and described herein, other garments may benefit from the fabrics and methods described herein. Such garments may include one or more of shirts, pants, jackets, coveralls, vests, and the like that are intended for use in various different applications. Moreover, the present disclosure is not limited to garments. More generally, the present disclosure pertains to UV-resistant fabrics irrespective of their application.

The fabrics used to make the outer shell 12 of the garment 10 and the outer layer 20 of the garment 18 can comprise a high-strength, flame-resistant fabric. In some embodiments, the fabric comprises inherently flame resistant fibers that form the fabric body. Examples of such inherently flame resistant fibers include aramid (aromatic polyamide) fibers, such as meta-aramid fibers and para-aramid fibers.

Example meta-aramid fibers include those sold under the trademark Nomex® by DuPont, and fibers that are currently available under the trademark Conex by Teijin.

Example para-aramid fibers include those that are currently available under the trademarks Kevla by DuPont, and Technora® and Twaron® by Teijin.

Other inherently flame resistant fibers suitable for construction of the fabric include, for example, polybenzoxazole (PBO), polybenzimidazole (PBI), melamine, polyamide, polyimide, polyimideamide, and modacrylic.

One or more other types of fibers may be blended with the inherently flame resistant fibers to construct the fabric. Examples of such fibers include cellulosic fibers, such as rayon, acetate, triacetate, and Iyocell. These cellulosic fibers, although not naturally resistant to flame, can be rendered flame resistant through application with an appropriate flame retardant. Generally speaking, cellulosic fibers that contain one or more flame retardants are given the designation "FR". Accordingly, the preferred flame resistant cellulosic fibers include FR rayon, FR acetate, FR triacetate, and FR lyocell.

Of the many blends conceivable using the above-described fibers, specific examples include 100% Nomex T-455®, 100% Nomex T-462®, 100% Nomex E114® (Z-200), a 65/35 blend of Nomex T-462® and FR rayon, a 60/40 blend of Nomex T-462® and FR rayon, a 60/40 blend of Kevlar T-970® and Nomex T-462®, a 60/40 blend of Kevlar T-970® and PBI, an 80/20 blend of Nomex T-462® and PBI, a 60/20/20 blend of Kevlar T-970®, PBO, and Nomex T-462®, a 50/50 blend of meta-aramid and modacrylic, a 60/40 blend of Kevlar Nomex T-970® and Basofil® (melamine), a 60/40 blend of meta-aramid and para-aramid, and 90/10 blend of meta-aramid and para-aramid. It is to be understood that these specific constructions are mere examples and are not intended to limit the scope of the present disclosure.

The fabric can be dyed to a desired shade of color using customary dyeing equipment. Typically, a dye, a dye assistant (or "carrier"), and a flame retardant for the non-inherently flame resistant fibers (if applicable), are combined to form a mixture, (e.g., a dyebath, solution, dispersion, or the like). Carriers aid in the absorption of dyestuff into the fibers of the fabric. In addition, some carriers aid in the solubilization of various UV-resistant additives that, as is discussed below, increase the UV resistance of the fibers and, therefore, the fabric. As an alternative to adding carrier to the mixture (e.g., dyebath), the carrier can instead be imbibed into the fibers during fiber production. When the fibers are imbibed with carrier, dyeing is conducted in the typical manner, except that additional carrier may not be needed in the mixture.

Once the mixture is formed, the fabric is contacted with the mixture, typically by immersion, and the mixture is heated to fix the dye in the fibers. Although the fabric has to been described as being dyed in the piece, dyeing can be performed during other stages of the production process. Therefore, dyeing can be performed on the fibers, on yarn, or on substantially any fibrous textile, including sliver. Suitable equipment for dyeing a textile include, for example, jig dyeing machines, pad dyeing machines, beck dyeing machines, and jet dyeing machines.

In addition to dye, UV-resistant additives can be incorporated into the fibers to increase the fibers' resistance to UV radiation. One type of UV-resistant additive is UV light absorbers. UV light absorbers are materials that absorb UV radiation to reduce the deleterious effects of that radiation on the medium (fibers in this case) in which the absorber is incorporated. Such UV light absorbers include, for example, benzophenone compounds, triazole compounds, and benzoic acid compounds. Specific examples, of UV light absorbers include Uvinul 3000 (2,4-dihydroxy-benzophenone), Uvinul 3049 (2,2'-dihydroxy-4,4'-dimethoxybenzophenone), Uvinul 3050 (2,2'-4,4'-tetrahydroxy-benzophenone), and Uvinul 3088 (2-propenoic acid,3-(4Omethoxyphenyl)-,2-ethylhexylester), all from BASF; Surftech 4500 (benzotriazole) from American Textile, LLC; and Tinuvin 234 (2-(2H-benzotriazol-2-yl)-4,6-bis(1-methyl-1-phenylethyl)phenol), Tinuvin 327 (2-(3,5,Di-(tert)-butyl-2-hydoxyphenyl)-5-chlorobenzotriazole) and Tinuvin 328 (2-hydroxy-3,5-di-(ter)-amylphenyl)benzotriazole) from Ciba Specialty Chemicals.

Another type of UV-resistant additive that can be incorporated into the fibers are hindered amine light (HAL) stabilizers. Such HAL stabilizers include, for example, amide compounds and piperidine compounds. Specific examples include Uvinul 4050H (N,N'-1,6-hexanediylbis(N-(2,2,6,6-tetramethyl-piperidinyl-formamide) from BASF, and Sanduvor 3058 Liquid(1-acetyl-4-(3-dodecyl-2,5-dioxo-1-pyrrolidinyl)-2,2,6,6-tetramethyl-piperidine from Clariant.

Tests suggest that UV light absorbers are particularly effective in improving fabric strength retention, while HAL stabilizers are particularly effective in improving fabric colorfastness. Although they can be used separately, incorporation of both a UV light absorber and a HAL stabilizer into a given fabric can yield improved results in terms of strength retention and/or colorfastness. Specific examples of UV light absorber/HAL stabilizer blends include Chimasrob 119FL (Chimasorb 119 (complex triazine) and Tinuvin 622 (sucinate polymer with piperidineethanol)) and Tinuvin 783LD (Tinuvin 622 and Chimasorb 944 (complex triazine)).

The UV-resistant additives can be incorporated into the fibers of the fabric at nearly any stage in the production process. Given that carriers that may be used as dye assistants in the dyeing process, it may be desirable to add the UV-resistant additives to the fibers during the dyeing process (assuming dyeing is performed). In such a case, the UV light absorber(s) can, for example, be provided in the mixture in a concentration of about 0.5% on weight of fabric (owl) to about 6% owf, and the HAL stabilizer(s) can, for example, be provided in the dyebath in a concentration from about 0.5% to about 3% owf. In some embodiments, concentrations of about 2% to 4% and 2% to 3% owf for UV light absorber and HAL stabilizer, respectively, are preferred. Examples of carriers that have been determined to solubilize UV light absorbers and/or HAL stabilizers include aryl ether, benzyl alcohol, N-cyclohexylpyrrolidone (CHP), N,N-diethyl-m-toluamide (DEET), dimethylformamide (DMF), dibutyl acetamide (DBA), Isophorone, Acetophenone, Dimethylacetamide, and Dibutylformamide.

A flame retardant compound can also be included in the mixture, applied as an after-dyeing surface treatment, or otherwise incorporated in the fibers of the fabric to enhance flame resistance or to counteract any deleterious effects of the carrier contained within the inherently flame resistant fibers. Furthermore, other chemicals can be applied to the fibers (e.g., added to the mixture) including lubricants, wetting agents, leveling agents, and the like.

Testing was performed to examine the effectiveness of UV light absorbers and HAL stabilizers that were incorporated in the fibers of fabric during the dye process. In that testing, various samples of fabric were tested for strength according to test methods described in ASTM D5733-99 and ASTM D1424-96 both before and after exposure to UV radiation (daylight). Some of those samples had been treated with a UV light absorber, a HAL stabilizer, or both, while others (the "controls") were left untreated.

Table I provides strength retention data for this testing.

TABLE I

STRENGTH RETENTION AFTER EXPOSURE TO UV RADIATION

| Fabric | Carrier | UV Light Absorber (owl) | HAL Stabilizer (owl) | % Warp Strength Retention | % Fill Strength Retention | Days Exposed |
|---|---|---|---|---|---|---|
| Nomex T-462 (CONTROL) | DEFT, 30 g/L | 0 | 0 | 81.2 | 80.4 | 14 |
| Noxex T-462 | DEET, 30 g/L | 6% benzophenone compound (Uvinul 3049) | 0 | 92.0 | 88.7 | 14 |
| Nomex T-462 (CONTROL) | CHP, 50 g/L | 0 | 0 | 78.3 | 80.8 | 14 |
| Nomex T-462 | CRP, 50 g/L | 6% benzophenone compound (Uvinul 3049) | 0 | 89.7 | 86.8 | 14 |
| Nomex T-462 (CONTROL) | benzyl alcohol, 70 g/L. | 0 | 0 | 77.1 | 67.4 | 14 |
| Nomex T-462 | benzyl alcohol, 70 g/L | 6% benzophenone compound (Uvinul 3049) | 0 | 76.2 | 80.3 | 14 |
| Nomex T-462 (CONTROL) | aryl ether, 45 g/L | 0 | 0 | 80.8 | 78.8 | 14 |
| Nomex T-462 | aryl ether, 45 g/L | 6% benzophenone compound (Uvinul 3049) | 0 | 83.8 | 89.6 | 14 |
| 65/35 Nomex T-462/FR rayon (CONTROL) | CHP, 30 g/L | 0 | 0 | 61.1 | 64.3 | 30 |
| 65/35 Nomex T-462/FR rayon | CHP, 30 g/L | 1% benzophenone compound (Uvinul 3049) | 0 | 76.0 | 73.1 | 30 |
| 65/35 Nomex T-462/FR rayon | CHP, 30 g/L | 2% benzophenone compound (Uvinul 3049) | 0 | 81.3 | 86.0 | 30 |
| 65/35 Nomex T-462/FR rayon | CHP, 30 g/L | 4% benzophenone compound (Uvinul 3049) | 0 | 86.0 | 86.7 | 30 |
| 65/35 Nomex T-462/FR rayon | CHP, 30 g/L | 6% benzophenone compound (Uvinul 3049) | 0 | 79.1 | 89.5 | 30 |
| 60/40 Kevlar T-970/Nomex T-462 (CONTROL) | benzyl alcohol, 70 g/L | 0 | 0 | 52.7 | 45.1 | 14 |
| 60/40 Kevlar T-970/Nomex T-462 | benzyl alcohol, 70 g/L | 6% benzophenone compound (UV-3049) | 0 | 66.7 | 58.4 | 14 |
| 60/40 Kevlar T-970/Nomex T-462 (CONTROL) | DEET, 30 g/L | 0 | 0 | 61.2 | 61.6 | 14 |
| 60/40 Kevlar T-970/Nomex T-462 | DEET, 30 g/L | 6% benzophenone compound (UV-3049) | 0 | 74.6 | 69.6 | 14 |
| 60/40 Kevlar T-970/Nomex T-462 (CONTROL) | CHP, 50 g/L | 0 | 0 | 63.1 | 56.7 | 14 |
| 60/40 Kevlar T-970/Nomex T-462 | CHP, 50 g/L. | 6% benzophenone compound (UV-3049) | 0 | 80.9 | 71.2 | 14 |
| 60/40 Kevlar T-970/Nomex T-462 | CHP, 50 g/L | 6% triazole compound (Surftech 4500) | 0 | 78.7 | 78.0 | 14 |

TABLE I-continued

STRENGTH RETENTION AFTER EXPOSURE TO UV RADIATION

| Fabric | Carrier | UV Light Absorber (owl) | HAL Stabilizer (owl) | % Warp Strength Retention | % Fill Strength Retention | Days Exposed |
|---|---|---|---|---|---|---|
| 60/40 Kevlar T-970/Nomex T-462 | CHP, 20 g/L | 4% benzophenone compound (UV-3049) | 1% piperidine/ compound (Sanduvor 3058 Liquid) | 73.7 | 66.7 | 30 |
| 60/40 Kevlar T-970/Nomex T-462 (CONTROL) | aryl ether, 45 g/L | 0 | 0 | 56.3 | 58.7 | 14 |
| 60/40 Kevlar T-970/Nomex T-462 | aryl ether, 45 g/L | 6% benzophenone compound (UV-3049) | 0 | 68.2 | 68.4 | 14 |
| 60/40 Kevlar T-970/Nomex T-462 | aryl ether, 45 g/L | 1% benzophenone compound (UV-3049) | 2% piperidine/ compound (Sanduvor 3058 Liquid) | 74.7 | 65.6 | 30 |

Various phases of testing were conducted. In one such phase (Phase A), various samples of 100% Nomex T-462® were tested for strength after 14 days of exposure to UV radiation in the form of sunlight using the trap tear test described in ASTM D5733-99, which is hereby incorporated by reference. Each sample was dyed or treated using a carrier, which comprised one of DEET, CHP, benzyl alcohol, and aryl ether. A control sample and a sample treated with a benzophenone compound (Uvinul 3049) were prepared using each carrier.

As can be appreciated from Table I, the samples that were treated with the benzophenone compound UV light absorber typically exhibited greatly improved strength retention in both the warp and fill directions after UV exposure. On average, each treated sample exhibited 7.8% greater strength retention as compared to the controls (i.e., 85.9% average for treated samples, 78.1% average for non-treated samples), and strength retention differences as high as 12.9% were observed.

In a second phase of the testing (Phase B), samples of a 65/35 blend of Nomex T-462® and FR rayon were tested for strength after 30 days of exposure to sunlight using the Elmendorf test described in ASTM D1424-96, which is hereby incorporated by reference. Each sample was dyed or treated using a CHP carrier, and each sample was treated with a different concentration of UV light absorber ranging from zero (i.e., for the control) to 6%. As is evident from the test data, significant strength retention increases were observed when the fabric was treated with levels of UV light absorber as low as 1% owf. In particular, the strength retention for the sample treated with 1% benzophenone compound (Uvinul 3049) was 14.9% greater in the warp direction and 8.8% greater in the fill direction as compared to the control sample. Greater strength retention was generally observed as the percentage of UV light absorber was increased.

In a third phase of the testing (Phase C), samples of a 60/40 blend of Kevlar T-970® and Nomex T-462® were tested for strength after 14 days, and in two cases 30 days, of exposure to sunlight. The samples were treated with various carriers and UV light absorbers. In addition, two samples were treated with a HAL stabilizer (in the 30 day exposure cases). Again, the samples that were treated with the UV light stabilizers exhibited increased strength retention. The testing conducted for the samples containing a HAL stabilizer appeared to indicate that similar results are possible in cases in which the concentration of UV light absorber was reduced and the concentration of HAL stabilizer was increased.

Further testing was performed to examine the effectiveness of UV light absorbers and HAL stabilizers in improving colorfastness of fabrics that are exposed to UV radiation. In this testing, various samples of fabric were tested for colorfastness according to AATCC Test Method 16-2003 (Option 3). Some of those samples had been treated with a UV light absorber, a HAL stabilizer, or both, while others (i.e., the controls) were left untreated. Table II provides colorfastness data for this testing.

TABLE II

COLORFASTNESS AFTER EXPOSURE TO UV RADIATION

| Fabric | Dye Assistant | UV Light Absorber (owl) | HAL Stabilizer (owl) | 20 hour UV | 40 hour UV | 60 hour UV |
|---|---|---|---|---|---|---|
| 60/40 Nomex T-462/FR rayon (CONTROL) | CHP | 0 | 0 | 3-4 | 3 | 2-3 |
| 60/40 Nomex T-462/FR rayon | CHP | 2.0% benzophenone compound (Uvinul 3049) | 2.0% amide compound (Uvinul 4050H) | 4-5 | 4-5 | 4-5 |

TABLE II-continued

| COLORFASTNESS AFTER EXPOSURE TO UV RADIATION | | | | | | |
|---|---|---|---|---|---|---|
| Fabric | Dye Assistant | UV Light Absorber (owl) | HAL Stabilizer (owl) | 20 hour UV | 40 hour UV | 60 hour UV |
| 60/40 Nomex T-462/FR rayon | CHP | 5.0% benzophenone compound (Uvinul 3049) | 2.0% hindered amide compound (Sanduvor 3058 Liquid) | 4-5 | 4-5 | 4-5 |
| 60/40 Nomex T-462/FR rayon | CHP | 3.0% benzophenone compound (Uvinul 3049) | 3.0% amide compound (Uvinul 4050H) | 4-5 | 4-5 | 4-5 |
| 60/40 Nomex T-462/FR rayon | CHP | 0 | 2.0% hindered amide compound (Sanduvor 3058 Liquid) | 4-5 | 4 | 4 |
| 60/40 Nomex T-462/FR rayon | CHP | 0 | 1.0% amide compound (Uvinul 4050H) | 4 | 4 | 3-4 |
| 60/40 Nomex T-462/FR rayon | CHP | 0 | 2.0% amide compound (Uvinul 405011) | 4 | 3-4 | 3-4 |
| 60/40 Nomex T-462/FR rayon | CHP | 1.0% benzophenone compound (Uvinul 3049) | 1.0% amide compound (Uvinul 4050H) | 3-4 | 3-4 | 3-4 |
| 60/40 Nomex T-462/FR rayon | CHP | 1.0% benzophenone compound (Uvinul 3049) | 0 | 3-4 | 3-4 | 3 |
| 60/40 Nomex T-462/FR rayon | CHP | 0 | 1.0% hindered amide compound (Sanduvor 3058 Liquid) | 3-4 | 3 | 3 |
| 60/40 Kevlar T-970/ Nomex T-462 (CONTROL) | aryl ether | 0 | 0 | 3 | 2-3 | 2-3 |
| 60/40 Kevlar T-970/Nomex T-462 | aryl ether | 3.0% benzophenone compound (Uvinul 3049) | 2.0% hindered amide compound (Sanduvor 3058 Liquid) | 3-4 | 3 | 3 |
| 60/40 Kevlar T-970/Nomex T-462 | aryl ether | 1.0% benzophenone compound (Uvinul 3049) | 1.0% amide compound (Uvinul 4050H) | 3-4 | 3 | 3 |
| 60/40 Kevlar T-970/Nomex T-462 | aryl ether | 1.0% benzophenone compound (Uvinul 3049) | 0 | 3-4 | 3 | 2-3 |
| 60/40 Kevlar T-970/Nomex T-462 (CONTROL) | CHP | 0 | 0 | 3 | 2-3 | 2-3 |
| 60/40 Kevlar T-970/Nomex T-462 | CHP | 0 | 2.0% hindered amide compound (Sanduvor 3058 Liquid) | 3-4 | 3 | 3 |
| 60/40 Kevlar T-970/Nomex T-462 | CHP | 1.0% benzophenone compound (Uvinul 3049) | 1.0% amide compound (Uvinul 405011) | 3 4 | 3 | 3 |
| 60/40 Kevlar T-970/Nomex T-462 | CHP | 1.0% benzophenone compound (Uvinul 3049) | 1.0% hindered amide compound (Sanduvor 3058 Liquid) | 3-4 | 3 | 3 |

According to AATTCC Test Method 16-2003, colorfastness is rated from a scale of 1 to 5, with "1" being the poorest colorfastness and "5" being the best colorfastness. As can be appreciated from Table II, the colorfastness of the fabrics treated with UV light absorbers and/or HAL stabilizers performed markedly better in terms of colorfastness as compared to the control fabrics.

While particular embodiments of the protective garments have been disclosed in detail in the foregoing description and drawings for purposes of example, it will be understood by those skilled in the art that variations and modifications thereof can be made without departing from the scope of the disclosure.

The invention claimed is:

1. A method, comprising:

first solubilizing an ultraviolet-resistant additive in a carrier to form a mixture; and thereafter immersing a fabric comprising a plurality of inherently flame resistant fibers in a bath comprising the mixture to cause the ultraviolet-resistant additive to be incorporated within the inherently flame resistant fibers;

wherein incorporation of the ultraviolet-resistant additive within the inherently flame resistant fibers significantly increases at least one of the strength retention and the colorfastness of the fabric when exposed to ultraviolet radiation.

2. The method of claim 1, wherein the inherently flame resistant fibers include aramid fibers.

3. The method of claim 1, wherein the inherently flame resistant fibers include polybenzoxazole (PBO) fibers, polybenzimidazole (PBI) fibers, melamine fibers, polyimide fibers, polyimideamide fibers, modacrylic fibers, or a blend thereof.

4. The method of claim 1, wherein the ultraviolet-resistant additive comprises an ultraviolet light absorber.

5. The method of claim 4, wherein the ultraviolet light absorber comprises a benzophenone compound, a triazole compound, a benzoic acid compound, or a mixture thereof.

6. The method of claim 4, wherein the ultraviolet light absorber is added to the mixture in a concentration of about 0.5 percent to about 6 percent on weight of fabric.

7. The method of claim 1, wherein the ultraviolet-resistant additive comprises a hindered amine light (HAL) stabilizer.

8. The method of claim 7, wherein the hindered amine light (HAL) stabilizer comprises an amide compound, a piperidine compound, or a mixture thereof.

9. The method of claim 7, wherein the hindered amine light (HAL) stabilizer is added to the mixture in a concentration of about 0.5 percent to about 3 percent on weight of fabric.

10. The method of claim 1, wherein the ultraviolet-resistant additive comprises both an ultraviolet light absorber and a hindered amine light (HAL) stabilizer.

11. The method of claim 1, wherein the carrier comprises aryl ether, benzyl alcohol, N-cyclohexylpyrrolidone (CHP), N,N-diethyl-m-toluamide (DEET), dimethylformamide (DMF), dibutyl acetamide (DBA), acetophenone, Isophorone, Acetophenone, Dimethylacetamide, and Dibutylformamide, or a mixture thereof.

12. The method of claim 1, wherein the mixture comprises a dye and the method is a dyeing method.

13. The method of claim 1, wherein the fabric retains from about 9% to about 31% more of its strength than untreated fabric when both fabrics are exposed to ultraviolet radiation for 14 days in accordance with ASTM D5733-99.

14. The method of claim 1, wherein the fabric retains from about 17% to about 38% more of its strength than untreated fabric when both fabrics are exposed to ultraviolet radiation for 30 days in accordance with ASTM D1424-96.

15. The method of claim 1, wherein the fabric would rate from about ½ to about 1 grade higher in its colorfastness than untreated fabric when both fabrics are exposed to ultraviolet radiation for 20 hours in accordance with AATCC Test Method 16-2003, Option 3.

16. The method of claim 1, wherein the fabric would rate from about ½ to about 1½ grades higher in its colorfastness than untreated fabric when both fabrics are exposed to ultraviolet radiation for 40 hours in accordance with AATCC Test Method 16-2003, Option 3.

17. The method of claim 1, wherein the fabric would rate from about ½ to about 2 grades higher in its colorfastness than untreated fabric when both fabrics are exposed to ultraviolet radiation for 60 hours in accordance with AATCC Test Method 16-2003, Option 3.

* * * * *